US005400455A

United States Patent [19]

Crossley

[11] Patent Number: 5,400,455

[45] Date of Patent: Mar. 28, 1995

[54] HAND HELD GOLF BALL WASHER

[76] Inventor: Norman Crossley, Box 268, Solon, Iowa 52333

[21] Appl. No.: 140,745

[22] Filed: Oct. 22, 1993

[51] Int. Cl.[6] ..... A63B 47/04

[52] U.S. Cl. ..... 15/21.2; 15/21.1

[58] Field of Search ..... 15/21.1, 21.2, 38, 39, 15/23, 97.1, 88.1, 88.2, 88.3

[56] References Cited

U.S. PATENT DOCUMENTS 1,587,068 6/1926 Dinehart ..... 15/21.2
3,006,009 10/1961 Hoffecker ..... 15/21.2
3,365,739 1/1968 Olinghouse ..... 15/21.2
4,381,574 5/1983 Benkovsky ..... 15/21.2

*Primary Examiner*—Edward L. Roberts
*Attorney, Agent, or Firm*—Allan L. Harms

[57] ABSTRACT

Hand held golf ball washing apparatus having a ball receiving chamber wherein a ring-shaped rotatable brush is positioned. The brush is driven on its axis by a battery-powered motor. Push button switch means is provided to selectively operate the motor. A removable hatch is provided in the apparatus to allow insertion and removal of a golf ball to be cleaned, and for insertion of a detergent solution.

14 Claims, 1 Drawing Sheet

HAND HELD GOLF BALL WASHER

BACKGROUND OF THE INVENTION

This invention pertains to golf ball washing devices and in particular to hand held golf ball washers.

In the course of the playing of the game of golf, it is inevitable that the golf ball becomes grass-stained and caked with mud. In order to make the driven ball easier to find and to ensure that its flight characteristics are not affected by the presence of mud or other foreign material upon the surface of the ball, it is useful to clean the surface of the golf ball to remove foreign material and grass or other stains.

Available golf ball washers which are known are predominantly nonportable and nonmotorized, such as illustrated in Burkholder, U.S. Pat. No. 3,678,526; Procario, U.S. Pat. No. 2,744,274; and Brillhart, U.S. Pat. No. 2,031,633. A manually driven, portable golf ball washer is disclosed in McConnell, U.S. Pat. No. 3,508,016.

A motorized portable golf ball washer is shown in U.S. Pat. No. 4,381,574 to Benkovsky which features a foam lined cup which rotates about the ball while held in place by a liner/retainer which resists turning of the ball. In order to wash the entire ball, it would be necessary to move the ball during the washing operation to another orientation in the cup so that the portion of the ball's surface which had been retained by the liner would then be washed.

Ingram et al., U.S. Pat. No. 4,084,287, teaches a hand operated portable ball cleaner which provides a toroidal sponge inside stiff rings which operates upon the golf ball's surface as the ball is manipulated by the user.

Stoltzman, U.S. Pat. No. 4,210,974, discloses an elongated ball washer for portable use featuring a bristle lined slot to receive the golf ball which is reciprocated in the slot.

British patent number 13,877 shows a washer powered by an egg beater mechanism which rotates the ball in contact with concave brush surfaces.

None of the above described washers provides a battery-powered, portable, hand-held golf ball washer which washes the entire ball surface in one operation and yet is simple to operate and maintain.

SUMMARY OF THE INVENTION

The present invention provides an improved, hand-held, battery powered golf ball washer having a case with a ball receiving chamber and a motor containing chamber, the ball receiving chamber having therein a ring shaped brush free to rotate within the ball receiving chamber and in relatively close relationship to the wall of the ball receiving chamber with the ball receiving chamber having a removable hatch therein positioned such that a golf ball may be inserted within the ring-shaped brush in the ball-receiving chamber, a detergent solution added, and the hatch closed, with motor and gear means within the motor containing chamber to drive the ring-shaped brush about the golf ball in the ball receiving chamber.

It is an object of this invention to provide an effective golf ball cleaner which can be carried with the golfer and employed as needed as the player proceeds along the golf course.

It is a further object of the Invention to provide a motorized golf ball washer which is portable and capable of washing the entire surface of the golf ball in a single operation.

It is a further object of the Invention to provide a golf ball washer which can be powered by dry cell batteries.

These and other objects of the Invention will be illustrated in the detailed description which follows.

DESCRIPTION OF THE DRAWING FIGURES

DETAILED DESCRIPTION OF THE INVENTION

Figure 1:
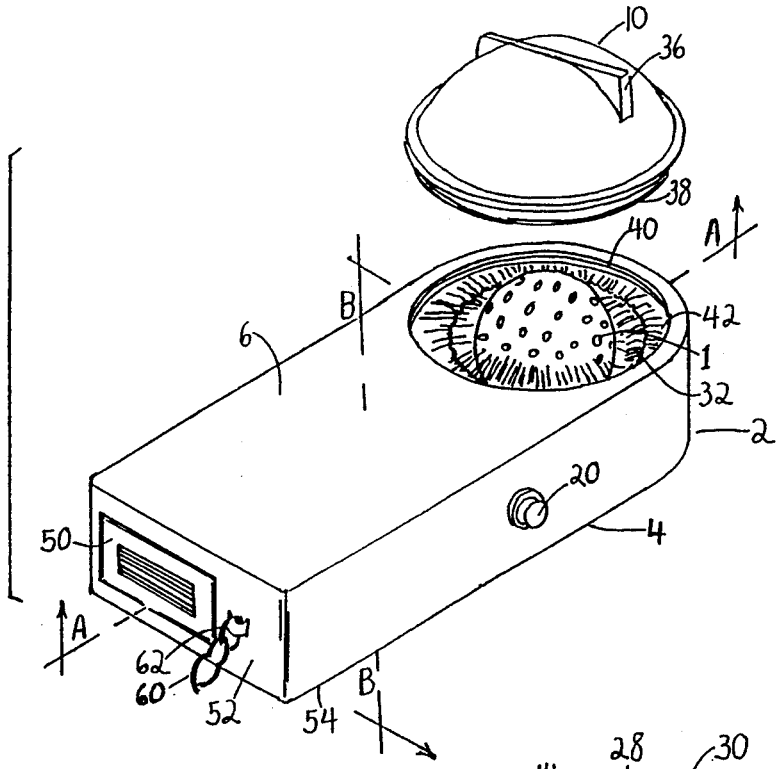
FIG. 1 is a perspective view of the preferred embodiment of the golf ball washer with its hatch member displaced therefrom and showing a golf ball in place therein.

The preferred embodiment of the present invention 2 is shown in perspective in FIG. 1. An elongate case 4 is provided with a front wall 6 having a removable hatch. Hatch member 10 is removably mounted to front wall 6 by thread means provided therefor, though other attachment means may be employed to close the opening in front wall 6. A push button normally open switch 20 is mounted upon case 4 at a convenient location therealong. It is to be understood that case 4 may be of cylindical hemispherical, rectangular, or other shape.

Figure 2:
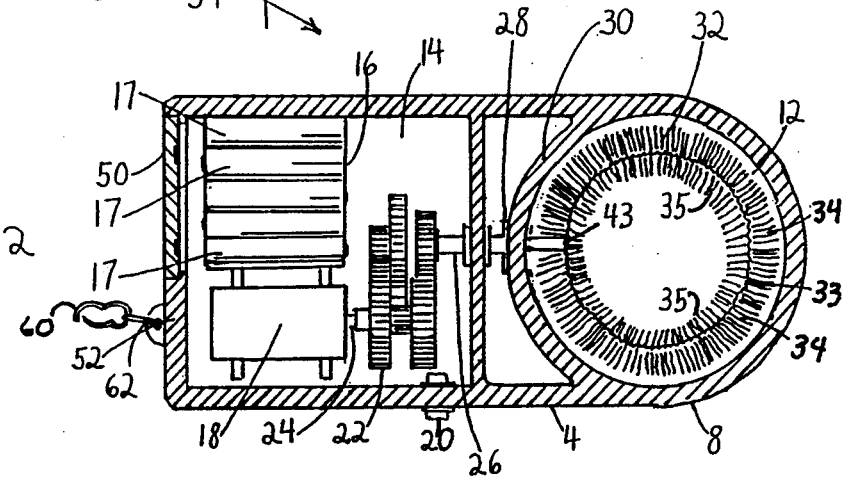
FIG. 2 is a cross section along line A—A of FIG. 1 with the golf ball omitted.
Figure 3:
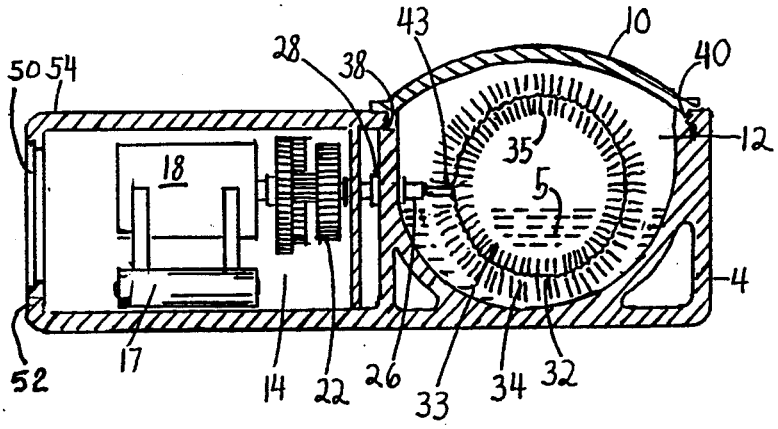
FIG. 3 is a cross section along line B—B of FIG. 1 with the golf ball omitted.

Referring to FIGS. 2 and 3, it can be visualized that case 4 is provided with a first chamber 12 and a second chamber 14 therein, the first chamber 12 being a ball receiving chamber which is located within first end 8 of case 4. In the preferred embodiment, first chamber 12 is substantially spherical in shapte. Case 4 also encloses second chamber 14 which is provided to receive a dry cell power supply 16 electrically connected to direct current motor 18 through switch 20 such that power supply 16 powers motor 18 when switch 20 is depressed. In the preferred embodiment, power supply 16 comprises dry cell batteries 17 connected in series. Reduction gears 22 decelerate the speed of shaft 24 of motor 18 such that driven shaft 26 is turned at a speed in the range of 50 to 300 revolutions per minute (RPM), preferably approximately 125 RPM. In the preferred embodiment, motor 18 is a d-c motor which operates on 1.5–3.0 VDC power at 4100–8300 RPM under load.

First chamber 12 and second chamber 14 are separated by curved watertight wall 30 which is provided with seal 28 through which passes driven shaft 26. Driven shaft 26 is mounted to annular brush member 32 at junction 43 such that annular brush member 32 will rotate on an axis generally coincident with the axis of case 4.

Annular brush member 32 is provided with bristles 34 which inwardly depend from frame 33 to engage the surface of a golf ball 1 placed within first chamber 12, such that inwardly depending ends 35 of bristles 34 will contact golf ball 1, as seen in FIG. 1. Detergent solution 5 is introduced into first chamber 12 in sufficient quantity to assist cleaning of goldball 1 by brush 32.

Figure 4:
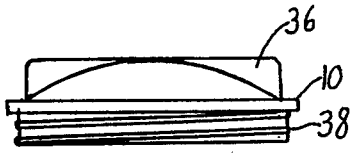
FIG. 4 is a plan view of the hatch memer of the golf ball washer.

Hatch member 10 is shown in plan view in FIG. 4. Hatch member 10 is provided with handle 36 such that the user of invention 2 may grasp handle 36 between thumb and forefinger and rotate hatch member 10 to remove it from or replace it on case 4. Screw threads 38 are provided on hatch member 10 in the preferred embodiment such that threads 38 may engage complementary threads 40 on opening 42 of case 4. Hatch member 10 is generally dome shaped to accomodate a golf ball thereunder.

Battery cover 50 is provided within end wall 52 of second end 54 of case 4 such that cover 50 may be removed in order to remove spent batteries 17 of power supply 16 and to install new batteries.

Clip 60 is provided by pivoted attachment means 62 upon case 4 to provide means for attachment of invention 2 to the user's golf bag, golf cart, or clothing.

OPERATION OF THE INVENTION

It can be readily seen that hatch member 10 may be removed from case 4 and a golf ball 1 inserted through opening 42 therein. A small amount of detergent solution 5 may be placed into first chamber 12 and hatch member 10 replaced into opening 42 to close first chamber 12. Push button switch 20 may be depressed by the user which causes motor 18 to be energized thereby driving reduction gears 22 which cause rotations of annular brush 32 through rotation of driven shaft 26. After sufficient operation of motor 18, the push button 20 is released and hatch member 10 removed such that golf ball 1, now clean, may be removed and used in the golf game.

Having described the invention, I claim:

1. A hand held golf ball washing apparatus comprising an elongate case having a first chamber and a second chamber separated by a watertight wall, the elongate case having an opening therein communicative with the first chamber, a hatch member receivable within said opening, a motor and power supply mounted within said second chamber, electrical switch means mounted on said case to selectively energize the motor, an annular brush member positioned in said first chamber and freely rotatable upon an axis coincident with the diameter of said brush member, driven shaft means interconnecting the annular brush member and the motor.

2. The golf ball washing apparatus of claim 1 wherein said elongate case having a first end within which said first chamber is positioned, the first end having a hemispherical outer wall.

3. The golf ball washing apparatus of claim 1 wherein said switch means is a normally open switch, said switch activated by manual means external to said case.

4. The golf ball washing apparatus of claim 1 wherein said switch means is a normally open push button switch mounted within the wall of said case.

5. The golf ball washing apparatus of claim 1 wherein gear reduction means are interpositioned between said motor and said annular brush member.

6. The golf ball washing apparatus of claim 1 wherein said brush member is driven at a rotational velocity in the range of 50–200 RPM.

7. The golf ball washing apparatus of claim 1 wherein said watertight wall is provided with seal means through which said driven shaft is positioned.

8. The golf ball washing apparatus of claim 1 wherein said power supply is a set of dry cell batteries electrically connected in series.

9. The golf ball washing apparatus of claim 1 wherein said first chamber is generally spherical.

10. The golf ball washing apparatus of claim 1 wherein said watertight wall is hemispherically shaped.

11. The golf ball washing apparatus of claim 10 wherein said watertight wall is provided with seal means through which said driven shaft is positioned.

12. The golf ball washing apparatus of claim 1 wherein said switch means is a normally open switch, said switch activated by manual means external to said case, gear reduction means are interpositioned between said motor and said annular brush member, said watertight wall is provided with seal means through which said driven shaft is positioned, said power supply is a set of dry cell batteries electrically connected in series, said first chamber is generally spherical.

13. The golf ball washing apparatus of claim 12 wherein said brush member is driven at a rotational velocity in the range of 50–200 RPM.

14. The golf ball washing apparatus of claim 12 wherein said hatch member is dome shaped.

* * * * *